US006615566B2

(12) United States Patent
Heisey

(10) Patent No.: US 6,615,566 B2
(45) Date of Patent: Sep. 9, 2003

(54) APPARATUS AND METHOD FOR AUTOMATICALLY WRAPPING SILVERWARE IN A NAPKIN

(75) Inventor: John L. Heisey, Phenix, AL (US)

(73) Assignee: Pureserve International Corp., Columbus, GA (US)

( * ) Notice: Subject to any disclaimer, the term of this patent is extended or adjusted under 35 U.S.C. 154(b) by 0 days.

(21) Appl. No.: 10/047,441

(22) Filed: Jan. 14, 2002

(65) Prior Publication Data

US 2002/0124534 A1 Sep. 12, 2002

Related U.S. Application Data

(60) Provisional application No. 60/201,680, filed on Jan. 12, 2001.

(51) Int. Cl.[7] ..... B65B 11/16

(52) U.S. Cl. ..... 53/466; 53/206; 53/222; 53/229

(58) Field of Search ..... 53/415, 466, 155, 53/206, 228, 229, 222, 209, 586, 588

(56) References Cited

U.S. PATENT DOCUMENTS 895,945 A * 8/1908 Berger ..... 53/222
2,017,314 A * 10/1935 Kux ..... 53/228
2,050,268 A * 8/1936 Bronader ..... 53/206
2,070,736 A * 2/1937 Johnson ..... 53/221
3,112,589 A * 12/1963 Willbrandt ..... 53/206
5,019,112 A 5/1991 Engelhardt et al.
5,237,801 A 8/1993 Hillam et al.
5,469,688 A 11/1995 Dunbar et al.
6,023,908 A * 2/2000 Vetsch ..... 53/155
6,023,913 A * 2/2000 Gray et al. ..... 53/218
6,202,387 B1 * 3/2001 Brown et al. ..... 53/590

* cited by examiner

*Primary Examiner*—John Sipos
(74) *Attorney, Agent, or Firm*—Gerald R. Boss; Ryan A. Schneider; Troutman Sanders LLP

(57) ABSTRACT

An apparatus and method are provided for wrapping a napkin around one or more utensils, wherein the utensils each have first end and a second ends defining a longitudinal axis. The utensil wrapping apparatus includes a utensil manipulator for placing the a utensil adjacent a surface of the napkin. First and second utensil engaging devices are provided for releasably engaging the first and second ends of the utensil and the portions of said napkin respectively adjacent the first and second ends of said utensil, such that said napkin and said utensil are held in a fixed relative position. A napkin guide for wrapping the napkin around the utensil, wherein the napkin guide is manipulable to orbit the longitudinal axis such that the napkin guide contacts the napkin and thereby wraps the napkin around said utensil.

12 Claims, 5 Drawing Sheets

APPARATUS AND METHOD FOR AUTOMATICALLY WRAPPING SILVERWARE IN A NAPKIN

This application claims priority to Provisional Patent Application No. 60/261,680 filed Jan. 12, 2001 entitled: "Apparatus And Method For Automatically Wrapping Silverware In A Napkin."

BACKGROUND OF THE INVENTION

1. Field of Invention

This invention relates generally to an apparatus and method for packaging selected items and in more particular to an apparatus and method for automatically wrapping silverware in a napkin.

2. Description of Related Art

Restaurants and other food service establishments frequently provide silverware to diners in a bundled form, wherein the utensils are bundled together within a napkin. This provides an easy way for the servers to handle the silverware without contacting the actual utensils and thereby helps to ensure the sterility and cleanliness of the utensils. The bundles are usually assembled manually by restaurant employees and may be sealed with a paper band or tape. In larger restaurants and food service establishments, the restaurant employee must often spend significant amounts of time engaged in folding napkins, significantly increasing the cost of operation of the restaurant. A number of automatic utensil packaging devices have been developed in the past in an attempt to reduce the cost associated with packaging utensils at restaurants.

For example, U.S. Pat. No. 5,469,688 to Dunbar et al. discloses an apparatus and method for wrapping silverware in a napkin. The napkin dispenser disclosed in the '688 patent automatically loads at least one napkin into a receiving area and an utensil dispenser automatically delivers utensils to the receiving area on top of the napkin. The napkin is automatically folded over the utensils rod at which point the utensils and surrounding napkin are then rotated by one or more rollers upon which they rest, causing the folded napkin to be wrapped longitudinally around the utensil. The napkin bundles produced by the device of the '688 patent apparently have open ends, potentially allowing contamination of the utensils during subsequent handling.

U.S. Pat. No. 5,019,112 to Engelhardt et al. discloses a robotic food service packaging system which utilizes a robotically controlled pincer for picking up utensils and placing a utensil within a bagger. This patent discloses positioning the utensil in a bin such that a portion of the utensil is exposed for being retrieved by a pincer. Once retrieved, the pincer is moved to place the utensil within a bag. However, placing utensils within bags is clearly not a desirable method for packaging utensils for higher class restaurants.

U.S. Pat. No. 5,237,801 to Hillam et al. also discloses an automated utensil packaging system. This patent discloses an automated system wherein a cluster of utensils are deposited on a continuous closed loop conveyer. A spreading chute and different travel rates along different portions of the conveyor separates the clustered items. Utensil pick-up systems include dedicated vision imaging and recognition systems for identifying the type of utensil to be picked up and the location for where the item is to be placed. The utensils are then deposited in a bucket. A napkin is also retrieved and placed within the bucket so that a complete set of utensils and napkins are associated with each respective bucket. Once a complete set has been picked, the bucket is dumped into a bagging machine which heat seals the entire set. Again, placing utensils within bags is clearly not a desirable method for packaging utensils for higher class restaurants.

Thus, none of these prior devices is ideal for the preparation of sterile napkin bundles containing utensils for use in all restaurants. During the sorting and bundling process, each of these processes generally requires that the silverware be handled by an individual, which can decrease the sterility of the utensils. Furthermore, each of these prior methods fails to completely enclose the utensil within a napkin to provide a complete barrier to contamination of the utensil. Thus, even with the most stringent sterility precautions in place, employee carelessness or inattention can still lead to contamination of the silverware with undesirable substances or microorganisms. Therefore, there is a need for a method of producing sterile bundles of silverware that does not require extensive handling of the silverware by employees after the silverware has been washed.

Accordingly, it is an object of the present invention to provide an apparatus and method for quickly and inexpensively preparing bundles of silverware wrapped in napkins.

Furthermore, it is an object of the present invention to provide an apparatus and method for preparing bundles of silverware wrapped in napkins which does not require handling of the silverware following sterilization.

It is yet another object of the present invention to provide an apparatus and method for wrapping utensils in a napkin which is capable of completely enclosing the utensils within the napkin to ensure sterility.

SUMMARY OF THE INVENTION

The above objectives are accomplished according to the present invention by providing an apparatus for wrapping a napkin around one or more utensils, wherein the utensils each have first and second ends defining a longitudinal axis. The utensil wrapping apparatus includes a utensil manipulator for placing a utensil adjacent a surface of the napkin. First and second utensil engaging devices are provided for releasably engaging the first and second ends of the utensil and the portions of said napkin respectively adjacent the first and second ends of said utensil, such that said napkin and said utensil are held in a fixed relative position. A napkin guide wraps the napkin around the utensil by orbiting around the longitudinal axis of the utensil such that the napkin guide contacts the napkin and thereby wraps the napkin around the utensil.

BRIEF DESCRIPTION OF THE DRAWINGS

The construction and design to carry out the invention will hereinafter be described together with other features thereof. The invention will be more readily understood from a reading of the following specification and by reference to the accompanying drawings forming a part thereof, wherein an example of the invention is shown and wherein.

DETAILED DESCRIPTION OF PREFERRED EMBODIMENTS

Figure 1:
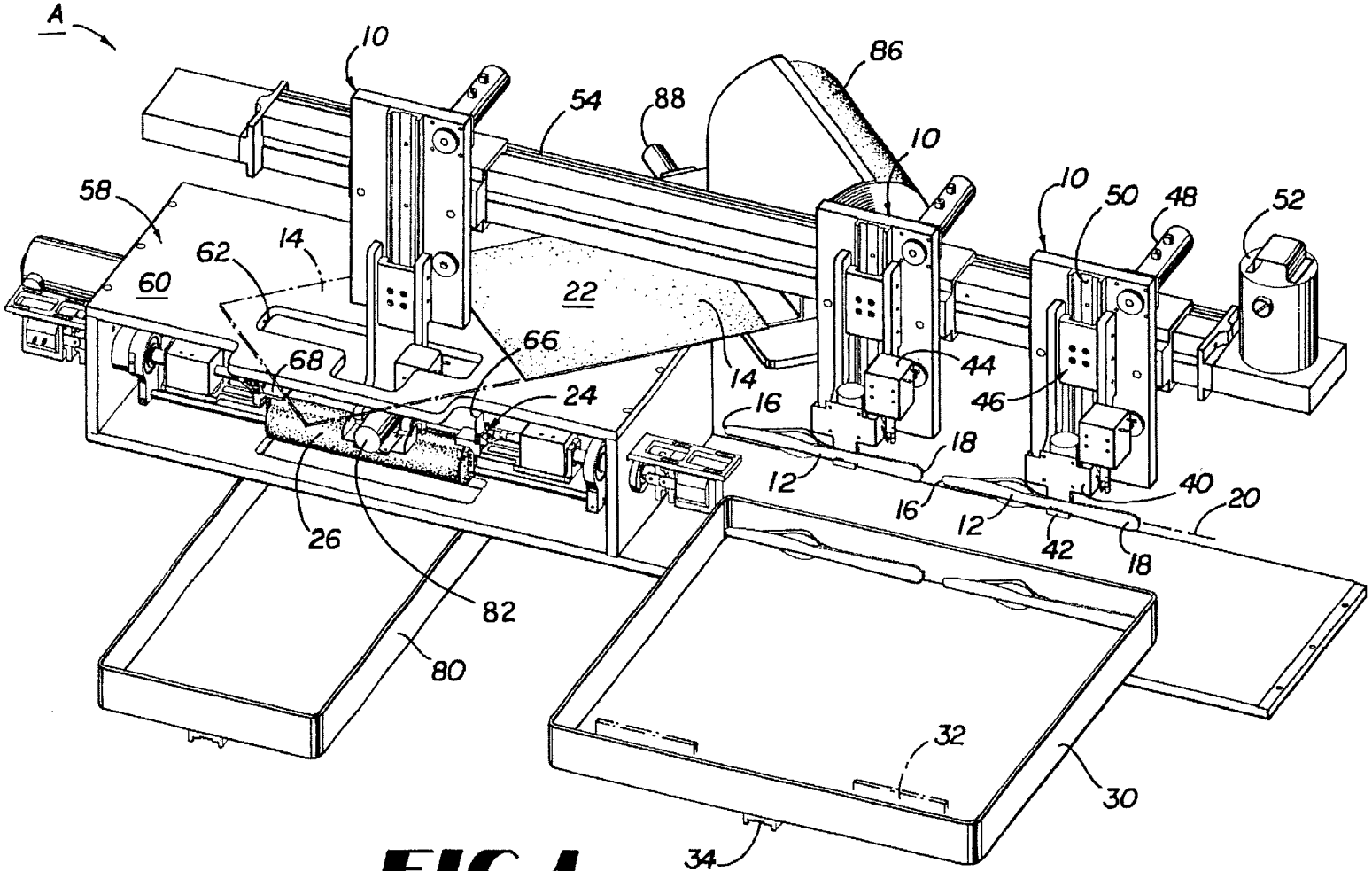
FIG. 1 is a perspective drawing illustrating a preferred embodiment of an apparatus for wrapping a napkin about one or more utensils in accordance with the present invention.
Figure 2:
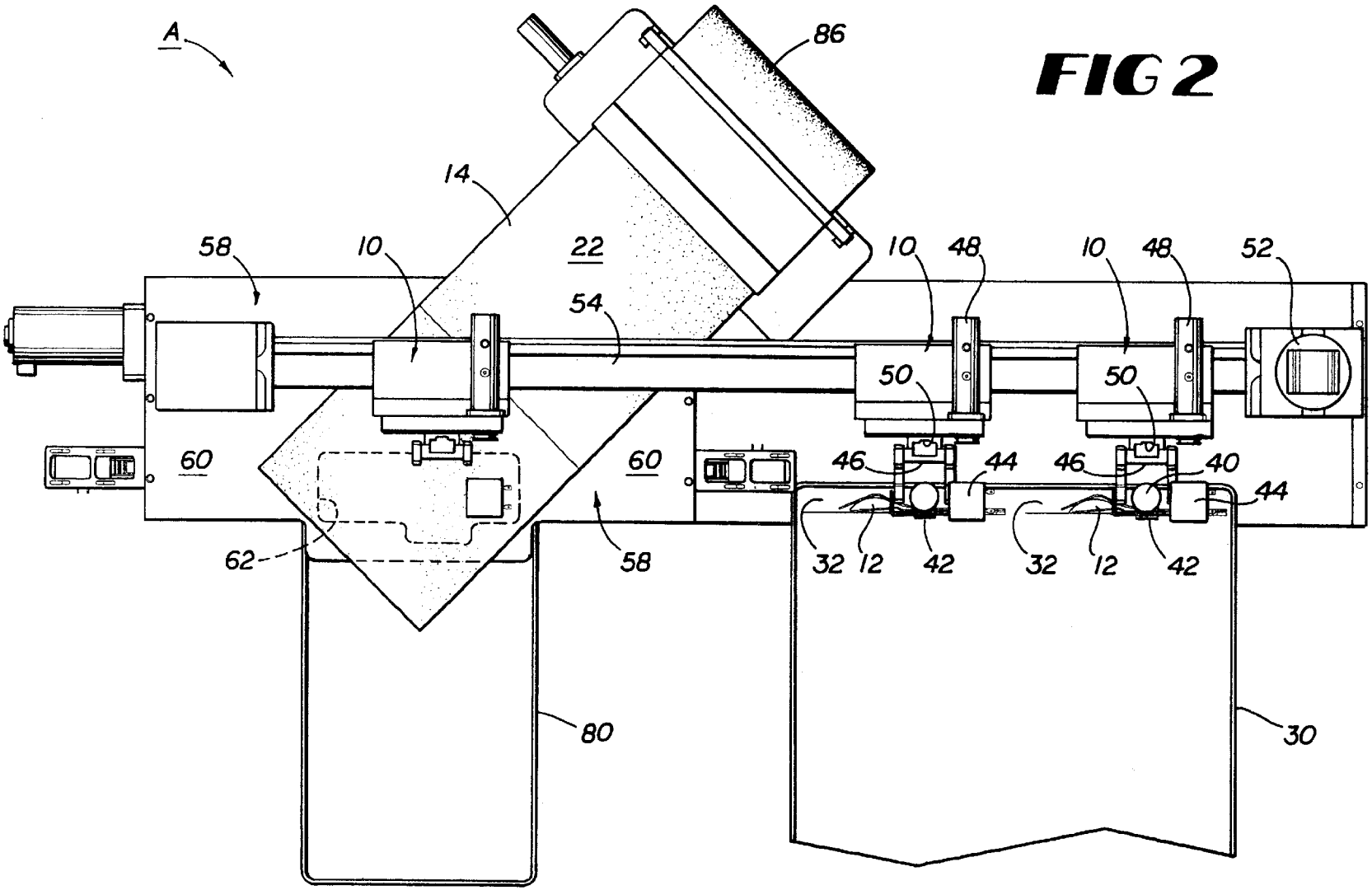
FIG. 2 is an overhead view of an apparatus for wrapping a napkin about one or more utensils in accordance with the embodiment of FIG. 1.
Figure 3:
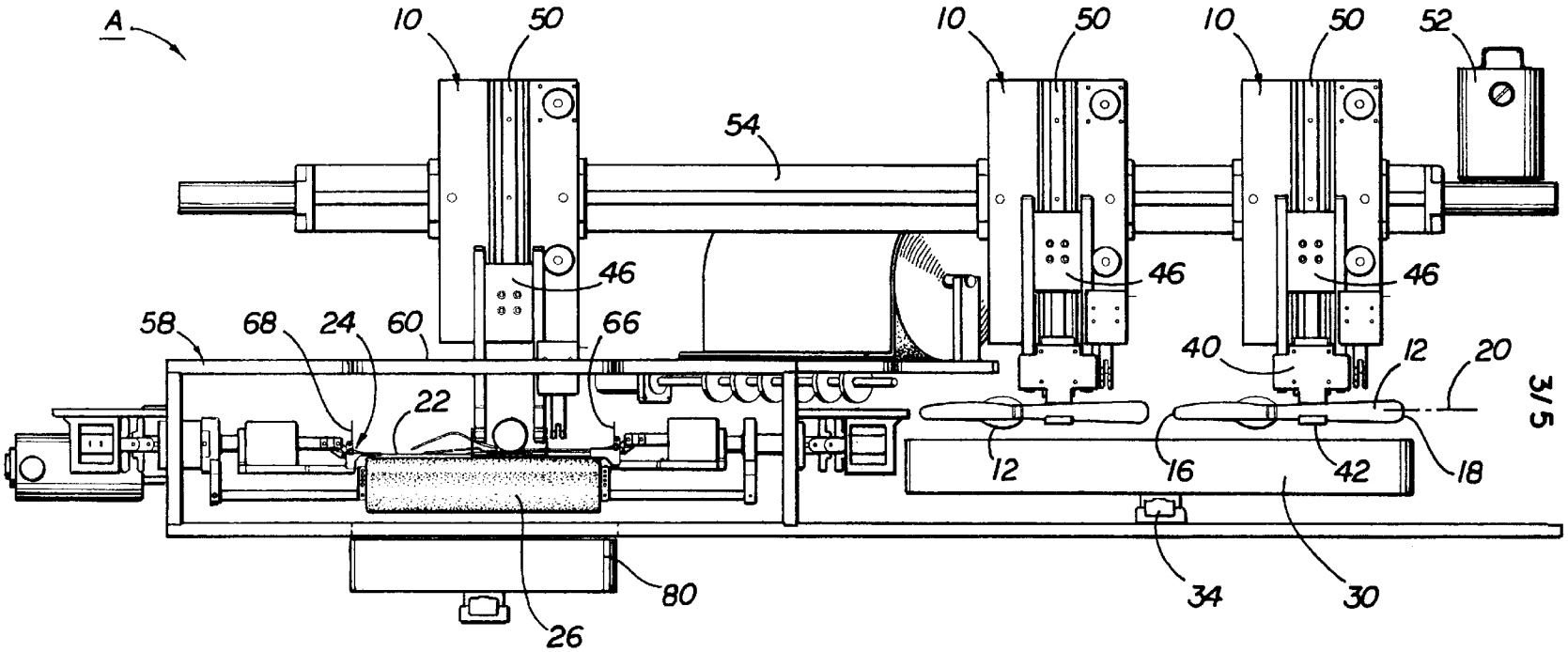
FIG. 3 is a front view of an apparatus for wrapping a napkin about one or more utensils in accordance with the embodiment of FIG. 1.

Referring now in more detail to the drawings, the invention will now be described in detail. As shown in FIGS. 1, 2 and 3, a utensil wrapper A is provided for wrapping one or more utensils within a napkin. Utensil wrapper A includes a utensil manipulator 10 for placing at least one utensil 12 adjacent a surface of a napkin 14, wherein utensil 12 includes a first end 16 and a second end 18 defining a longitudinal axis 20. Utensil manipulator 10 places utensil 12 onto a napkin 22 and positions utensil 12 and napkin 22 into alignment with a utensil engaging device 24, which releasably engages first end 16 and second end 18 of utensil 12 and the adjacent portions of napkin 22, thereby holding utensil 12 and napkin 22 in a fixed relative position. A napkin guide 26 is provided to orbit the longitudinal axis of utensil 12 when utensil 12 is engaged by utensil engaging device 24, such that napkin guide 26 contacts napkin 22 and, through its orbital motion wraps napkin 22 around utensil 12.

In the preferred embodiment, utensil manipulator 10 is adapted to retrieve one or more pre-sorted utensils from a utensil sorting tray 30. Utensil sorting tray 30 may include a plurality of discrete utensil compartments 32 which are arranged in a rectangular array, wherein a preselected plurality of utensils are positioned within each representative utensil compartment 32. In operation, a utensil sorting tray manipulator 34 may be provided to incrementally move utensil tray 30, thereby presenting a utensil 12 in a representative utensil compartment 32 for sequential retrieval by utensil manipulator 10. Because the utensil sorting tray 30 is moved, utensil manipulator 10 may repeatedly retrieve utensils 12 from utensil sorting tray 30 at a fixed location, thereby simplifying the design and operation of utensil manipulator 10. One of ordinary skill in the art will recognize that utensil compartments 32 may be arranged in a variety of patterns within utensil sorting tray 30, such as a radial arrangement for presentation to utensil manipulator 10.

In a more preferred embodiment, utensil sorting tray 30 may also be adapted for use to hold presorted utensils in a commercial dishwasher. Because utensil sorting tray 30 may be moved directly from the dishwasher into alignment with utensil manipulator 10, it is possible to move the washed utensils without requiring potentially unsanitary human contact with the individual utensils after washing. This is clearly advantageous over prior devices which require actual handling or sorting of utensils after washing which may lead to unsanitary contamination of the utensils.

In a preferred embodiment, utensil manipulator 10 includes a first utensil engaging device 40 for releasably engaging utensil 12 and moving it to a desired location. For example, as shown in FIG. 3, first utensil engaging device 40 may include a solenoid activated clamp 42 which may be activated to releasably engage utensil 12. First utensil engaging device 40 may also be any of a great variety of other clamps or pincers commonly utilized in similar applications and may be driven by a variety of actuators including motors and hydraulic or pneumatic cylinders.

After engaging utensil 12, first utensil engaging device 40 may be moved via a motivator 44 to move utensil 12 to a desired location. In the preferred embodiment, motivator 44 includes a vertical motivator 46 comprising a step motor 48 for actuating motion along a vertical track 50, and a horizontal motivator comprising a step motor 52 for actuating motion along a horizontal track 54 to bring first utensil engaging device 40 into a desired alignment with a napkin support 58. One of ordinary skill in the art will recognize that any of a wide variety of commonly used actuators may be used to drive motivator 44 and that any of a wide variety of common drive systems, included but not limited to, chains, cables, belts and direct drive systems may be utilized to couple motor power to motivator 44.

In a preferred embodiment, napkin support 58 includes a substantially horizontally disposed plate 60 having a utensil passage 62 extending therethrough for allowing passage of utensil 12. In operation, a napkin 14 may be positioned on napkin support 58 as shown in FIGS. 1 and 2. Utensil manipulator 10 may then be utilized to move a selected utensil from wash tray 30 into alignment with utensil passage 62. Utensil manipulator 10 then lowers first utensil engaging device 40 and engaged utensil 12 through utensil passage 62, consequentially also deforming napkin 14 into utensil passage 62. Once through utensil passage 62, utensil manipulator 10 positions utensil 12 for engagement by second and third utensil engaging devices 66 and 68, followed by release of utensil 12 from first utensil engaging device 40 and retraction of utensil manipulator 10 though utensil passage 62.

Second and third utensil engaging devices 66 and 68 comprising of releasable clamps that are disposed to receive and engage the respective ends of a utensil 12. Second and third utensil engaging devices 66 and 68 may also be positioned such that when activated they also each engage a portion of napkin 14, holding it in a fixed relation to utensil 12. In a preferred configuration, shown in FIG. 4, napkin 14 is positioned diagonally across utensil 12 such that the corner portions of napkin 14 substantially overhang the respective ends of utensil 12. Thus, upon activation of second and third utensil engaging devices 66 and 68, the corner portions of napkin 14 are folded over the respective ends of utensil 12, thereby allowing creation of a sealed napkin bundle 70 having closed ends. This configuration has the benefits that the finished napkin bundle 10 is both more secure and sanitary than would be the case with an open-ended bundle.

Figure 5:
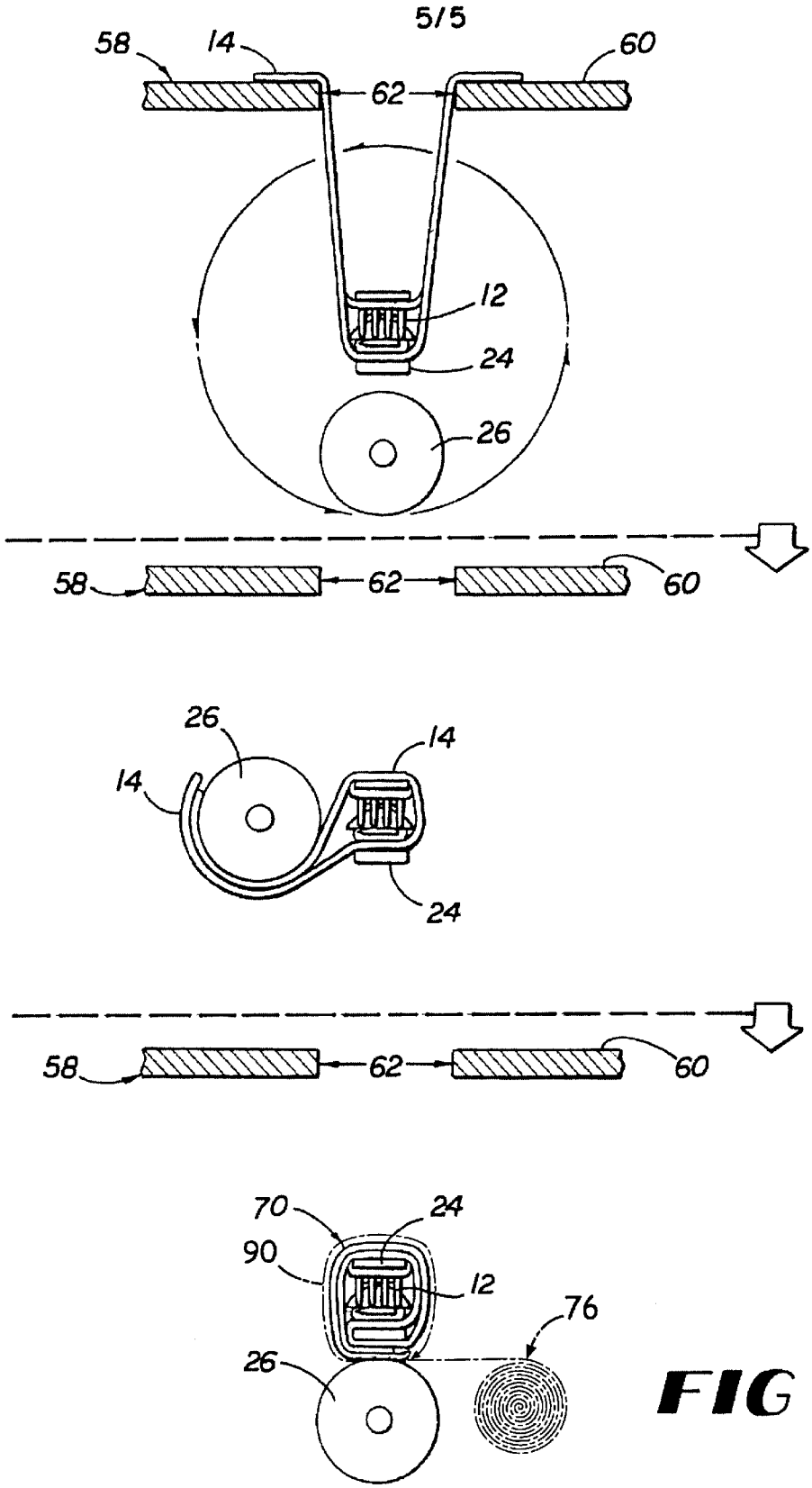
FIG. 5 illustrated an end view of the utensil wrapping process in accordance with a preferred embodiment of the present invention.

Napkin guide 26 is a longitudinal member such as a roller, bar, rod, arm or wire which is axially disposed parallel to the longitudinal axis of utensil 12 when utensil 12 is and napkin 24 are engaged by second and third utensil engaging devices 66 and 68. As shown in FIG. 5 napkin guide 26 is carried by a rotating motor having an axis of rotation at the longitudinal axis of utensil 12, thereby allowing free revolution of napkin guide 26 completely around utensil 12. In operation, napkin guide 26 revolves around utensil, engaging the portion of napkin 14 extending through utensil passage 62 and causing the napkin 14 to wrap around utensil 12 to form a napkin bundle 70 as shown in FIG. 5. In the preferred embodiment, when wrapped into napkin bundle 70 napkin 14 completely encloses utensil 12 sealing it within to maintain its cleanliness and sanitary state.

Utensil wrapper A may also optionally include an applicator 76 for applying a securing element 90 to bundle 78 to ensure that napkin 14 does not unroll from utensil 12 upon release by second and third utensil engaging devices 66 and 68. In the preferred embodiment, applicator 76 is a tape applicator which applies a short length of an adhesive tape to secure an overlapping portion of napkin bundle 70. It is also contemplated that a variety of other securing elements, such as sleeves, ties, or an adhesive, might be applied to secure napkin bundle 70 by methods which are well known in the art.

A catch tray 80 may be positioned beneath second and third utensil engaging devices 66 and 68 such that, when release by second and third utensil engaging devices 66 and 68, napkin bundle 70 falls therein due to the force of gravity. It may also be desirable to include an ejector 82 for pushing utensil bundle 70 off of second and third utensil engaging devices 66 and 68 upon release thereby to ensure that napkin bundle 70 falls into catch tray 80. Ejector 82 may comprise any mechanical mechanism for bumping or shifting napkin bundle 70 off of second and third utensil engaging devices 66 and 68.

As can be see in FIG. 1, in a preferred embodiment napkin 14 may be automatically provided from a roll of napkin material 86. Prior to positioning of utensil 12 by manipulator 10 a section of napkin material 86 may be positioned upon napkin support 58 as shown. A blade 88 then slices a section of napkin material 88 at a desired location to create a napkin 90 having a desired size. Alternatively, precut napkins could also be positioned upon napkin support 58 by any conventional sorting or dispensing mechanism which would typically be available to one of ordinary skill in the art.

Thus is operation, utensil wrapper A can be used to wrap a napkin 14 about one or more utensils 12 using the steps of the following method. First, a utensil 12 is positioned adjacent a surface of a napkin 14, wherein the utensil 12 has a first end and a second end defining a longitudinal axis. Then the first and second ends of the utensil 12 and the portions of the napkin 14 respectively adjacent the first and second ends of the utensil 12 are engaged, to hold the napkin 14 and the utensil 12 in a fixed relative position. A napkin guide 26 is then orbited about the longitudinal axis of utensil 12 such that the napkin guide 26 contacts the napkin 14 and thereby wraps the napkin 14 around the utensil 12 at which point the first and second ends of the utensil 12 are released. Additionally, when the first and second ends of the utensil 12 are engaged, the corner portions of napkin 14 may be folded to enclose the ends of utensil 12, thereby ensuring that napkin 14 completely encloses utensil 12.

More specifically, according to a preferred embodiment, it can be seen that a pre-washed utensil 12 may be completely wrapped within a napkin 14 without requiring human contact with the utensil. In this embodiment, utensils 12 are first sorted either manually or automatically into desired combinations in a utensil sorting tray 30. Once loaded, the utensil sorting tray 30 is then loaded into a commercial dishwasher and the utensils 12 held therein are washed and dried much as in any conventional commercial dishwasher utensil rack.

Next, the utensil sorting tray 30 is positioned to present a first utensil compartment 32 to a loading area of a utensil engaging device 40 of a motivator 10 which engages the utensil or pre-sorted plurality of utensils 12 contained within the respective utensil compartment 32 and moves them to a desired location for wrapping. Utensil sorting tray 30 is then incrementally moved to present another utensil compartment 32 to the loading area of utensil motivator 10. This may be repeated by incrementally moving utensil sorting tray 30 until all utensils have been removed therefrom, allowing loading of all utensils from a single position and thereby simplifying the operation of utensil motivator 10.

Figure 4:
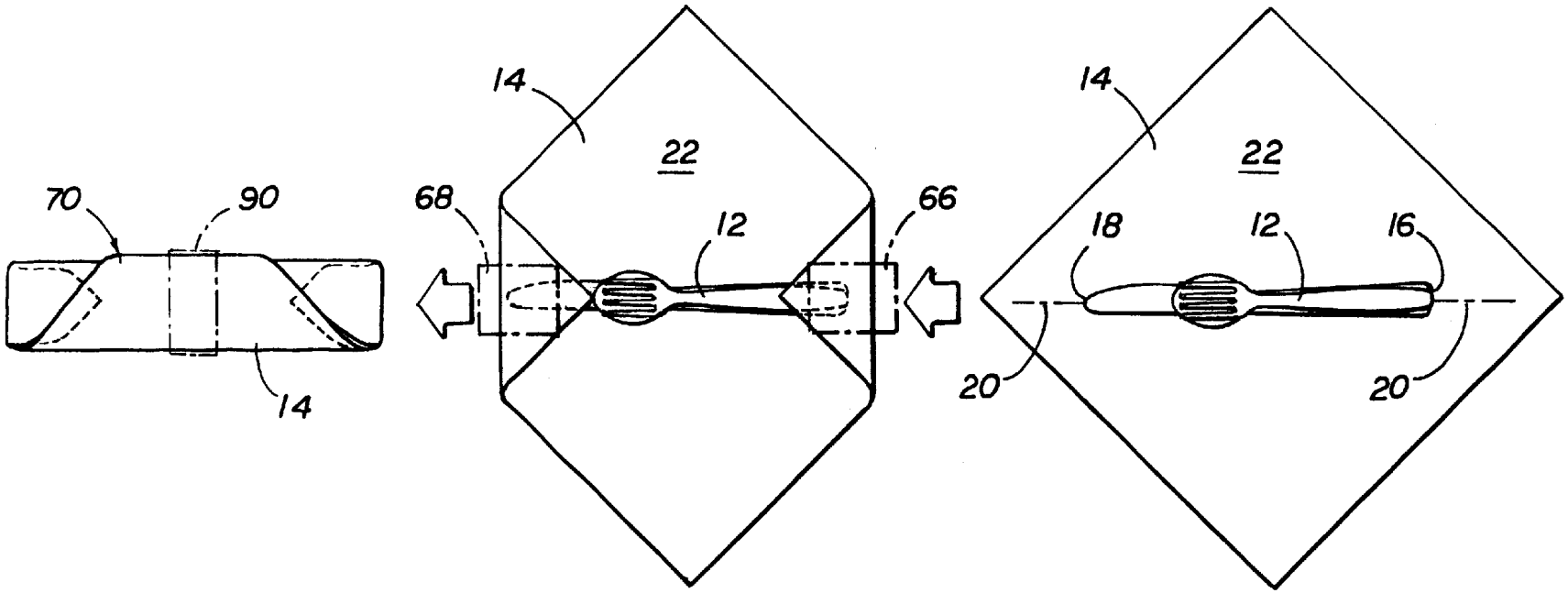
FIG. 4 illustrates an overhead view of the positioning and folding of a napkin in accordance with a preferred embodiment of the present invention.

As shown in FIG. 1 utensil motivator 10 moves the engaged utensil or utensils 12 to a napkin support 58 upon which a napkin 12 has been pre-positioned. In the preferred embodiment, napkin 12 is placed onto napkin support 58 from a roll of napkin material 86 and is sliced to form an appropriately sized napkin. In the preferred embodiment, napkin 14 is positioned on napkin support 58 to diagonally overlay a utensil passage 62, as shown in FIG. 4.

Utensil 12 is then lowered by utensil motivator 10 through utensil passage 62 and brought into alignment with second and third utensil engaging devices 66 and 68 which engage its respective ends to fixedly hold utensil 12. All subsequent wrapping steps occur with the utensil 12 held in a fixed position, thereby simplifying the operation of the utensil wrapper A in comparison to prior art utensil wrappers which require movement of a utensil to wrap it within a napkin.

As shown in FIG. 5, lowering utensil 12 through utensil passage 62 also serves to depress and effectively fold napkin 14, leaving a portion thereof extending up though utensil passage 63. The corner ends of napkin 14 also overhang the ends of utensil 12, therefore, when utensil 12 is engaged by second and third utensil engaging devices 66 and 68, the corners of napkin 14 are folded over the ends of utensil 12 and also engaged by second and third utensil engaging devices 66 and 68.

Next, napkin guide 26 is orbitally rotated around immobilized utensil 12, as shown in FIG. 5, wrapping napkin 14 thereabout to form napkin bundle 70. The folding of the corners of napkin 14 by second and third utensil engaging devices 66 and 68 ensures that the finished napkin bundle 70 to completely enclose utensil 12 rather than having open ends. Once wrapped, a securing element 90 may be applied to napkin bundle 70 by applicator 76 to securely close napkin bundle 70. The finished napkin bundle 70 is then release and falls via force of gravity into a catch tray 80.

It thus will be appreciated that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. An apparatus for wrapping a napkin around one or more utensils, said apparatus comprising:

a utensil manipulator for placing a utensil adjacent a surface of a napkin, wherein said utensil has a first end and a second end defining a longitudinal axis and for folding said napkin in a U-shape around said utensils with napkin portions extending past said first and second ends;

first and second utensil engaging devices for releasably engaging said first and second ends of said utensil and said portions of said napkin respectively adjacent said first and second ends of said utensil, such that said portions of said napkin and said utensil are held in a fixed relative position for folding said first and second portions over the ends of the utensil; and a napkin guide for orbiting said longitudinal axis to wrap said napkin around said utensil such that said napkin guide contacts said napkin and thereby wraps said napkin around said utensil while said napkin portions and utensil are held in fixed relative position.

2. The apparatus of claim 1 further including a platform having an opening extending therethrough through which said utensil may be passed while said napkin is supported upon said platform, thereby positioning said utensil in a fold of said napkin.

3. The apparatus of claim 1, wherein said napkin guide is an element selected from the group consisting of a roller, a bar, an arm, and a wire.

4. The apparatus of claim 1, wherein said first and second utensil engaging devices are clamps adapted to grasp the ends of said utensil.

5. The apparatus of claim 1, further including an applicator for applying a securing element to secure said napkin about said utensil after folding.

6. The apparatus of claim 5, wherein said securing element is selected from the group consisting of: tape, adhesive, a tie, or a sleeve.

7. The apparatus of claim 1, wherein said utensil manipulator is adapted to retrieve said utensil directly from a washing tray for placement adjacent said napkin.

8. The apparatus of claim 1, wherein said utensil includes an interlocking plurality of utensils.

9. A method for wrapping a napkin around one or more utensils, said method comprising the steps of:

positioning a utensil adjacent a surface of a napkin, wherein said utensil has a first end and a second end defining a longitudinal axis and folding said napkin in a U-shape around said utensils with napkin portions extending past said first and second ends;

engaging said first and second ends of said utensil and said portions of said napkin respectively adjacent said first and second ends of said utensil, such that said napkin and said utensil are held in a fixed relative position and folding said first and second portions over the ends of the utensil;

manipulating a napkin guide to orbit said longitudinal axis such that said napkin guide contacts said napkin and thereby wraps said napkin around said utensil while said napkin portions and utensil are held in fixed relative position;

and releasing said first and second ends of said utensil.

10. The method of claim 9, wherein said utensil manipulating step includes the step of passing said utensil through an opening extending through a platform while said napkin is supported upon said platform, thereby positioning said utensil upon said napkin.

11. The method of claim 9, further including the step of applying a securing element to secure said napkin about said utensil after wrapping.

12. The method of claim 9, further including the step of retrieving said utensil directly from a washing tray for placement adjacent said napkin.

* * * * *